US006626528B2

(12) United States Patent
Tsukuda

(10) Patent No.: US 6,626,528 B2
(45) Date of Patent: Sep. 30, 2003

(54) INK JET PRINT HEAD WITH BUBBLE DISCHARGE

(75) Inventor: Keiichiro Tsukuda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/986,003

(22) Filed: Nov. 7, 2001

(65) Prior Publication Data

US 2002/0097307 A1 Jul. 25, 2002

(30) Foreign Application Priority Data

Nov. 15, 2000 (JP) ..... 2000/348643

(51) Int. Cl.[7] ..... B41J 2/19; B41J 2/175
(52) U.S. Cl. ..... 347/92; 347/93
(58) Field of Search ..... 347/92, 93

(56) References Cited

U.S. PATENT DOCUMENTS 4,301,459 A * 11/1981 Isayama et al. ..... 347/92
4,313,124 A 1/1982 Hara
4,345,262 A 8/1982 Shirato et al.
4,459,600 A 7/1984 Sato et al.
4,463,359 A 7/1984 Ayata et al.
4,558,333 A 12/1985 Sugitani et al.
4,608,577 A 8/1986 Hori
4,723,129 A 2/1988 Endo et al.
4,740,796 A 4/1988 Endo et al.
5,113,205 A * 5/1992 Sato et al. ..... 347/92

FOREIGN PATENT DOCUMENTS

JP 54-56847 5/1979
JP 59-123670 7/1984
JP 59-138461 8/1984
JP 60-71260 4/1985

OTHER PUBLICATIONS

Application No. 09/954,071, filed Sep. 18, 2001.

* cited by examiner

*Primary Examiner*—Judy Nguyen
(74) *Attorney, Agent, or Firm*—Fitzpatrick, Cella, Harper & Scinto

(57) ABSTRACT

An ink jet print head has a bubble collecting device in an ink liquid chamber between a filter and an ink ejection opening for ejecting ink, a bubble moving device for moving bubbles to the bubble collecting device, and a bubble discharging device for discharging bubbles accumulated in the bubble collecting device to the outside. Further, an ink jet printing apparatus performs printing using an ink jet print head having a bubble collecting device in an ink liquid chamber between a filter and an ink ejection opening for ejecting ink, a bubble moving device for moving bubbles to the bubble collecting device, and a bubble discharging device for discharging the bubbles accumulated in the bubble collecting device to the outside.

6 Claims, 6 Drawing Sheets

INK JET PRINT HEAD WITH BUBBLE DISCHARGE

This application is based on Patent Application No. 2000-348643 filed Nov. 15, 2000 in Japan, the content of which is incorporated hereinto by reference.

BACKGROUND OF THE INVENTION

1. Field of the Invention

The present invention relates to an ink jet print head and an ink jet printing apparatus using the same ink jet print head.

2. Description of the Related Art

There are various types of ink jet printing apparatus for performing printing on a printing medium by ejecting ink from an ink ejection opening and an ink jet print head used in the ink jet printing apparatus. Among these, typical examples of ink supply method to the ink jet print head include the following.

First, as a first type, there is a type in which using a tube from an ink vessel containing the ink, ink is supplied to the ink jet print head through a filter for preventing fine dust from coming in the ink jet print head, in this type, when ink in the ink vessel is exhausted, the ink vessel is replaced, and in this case, for preventing bubbles from mixing in the ink jet print head, it is general that ink is suction recovered or pressure recovered from the ink jet print head. Such an ink jet printing apparatus is often used in a large-sized ink jet printing apparatus.

Further, as a second other type, there is an ink jet printing apparatus using an on-carriage type ink jet cartridge of a structure integrally including an ink vessel and an ink jet print head. Such a type is often used in a relatively small-sized ink jet printing apparatus, which is widely used because replacement or the like of the ink jet print cartridge is simple. However, in such type of ink jet cartridge, when the ink vessel is replaced at the time the ink in the ink vessel is exhausted, because ink jet print head is wasted at the same time, recently, in view of running cost and environmental problems, various kinds of on-carriage type ink jet print cartridges are often proposed which allow replacement of only the ink vessel when the ink is exhausted.

The ink cartridge used in the second type ink jet printing apparatus is generally divided into an energy generation substrate for ejecting the ink, an ink jet print chip provided with an ink ejection opening corresponding to an energy generation element incorporated in the substrate, an ink jet print head portion provided with a filter for supplying ink not containing fine dust to the ink jet print chip, and an ink vessel portion for storing the ink, when the ink vessel is replaced, it is general that a suction recovery is performed for preventing air bubbles from coming into the ink jet print head which disturb stable printing.

However, even though the suction recovery is necessary when the ink vessel is replaced, if the suction recovery is performed many times, ink consumption other than for printing is increased which greatly increases the running cost. Further, for example, as one of general-purpose ones used as energy generation means for ejecting ink of the ink print head, an electrothermal converter (heater) is used. This is one which by energizing the heater, film boiling is generated in the ink so that the ink is ejected by the force. In this ink ejection process, dissolved air contained in the ink is generated as a gas even in small amount. If such a bubble builds up to a large amount, since it has an adverse effect on printing, before the bubble present in the ink jet print head becomes a size to have an adverse effect on printing, it is necessary to perform suction recovery of the ink jet print head. Also in this case, since ink consumption not used for printing occurs, there is a problem of an increased running cost.

In an ordinary ink jet print head, for example, as shown in FIG. 6, an ink jet print head 100 has a casing 102 integral with an ink vessel like an ink tank, this casing 102 forms an ink liquid chamber 103, and a filter 104 is provided between the ink vessel. Further, in the casing 102, at the opposite side to this filter 104, an ink jet print chip portion 105 for ejecting ink to make printing is provided. The filter 104 is to remove impurities such as dust contained in the ink supplied from the ink vessel so that a clean ink is supplied into the ink liquid chamber 103. Further, in the ink liquid chamber 103, a sheet of plate member 106 is inclinedly provided, and a gap S is formed between the lower side end of the plate member 106 and the casing 102. Therefore, as shown in the figure, the ink supplied into the ink liquid chamber 103 passes through the gap S between the end of the plate member 106 and the casing 102 to be supplied to the energy generation means for ejecting the ink and the ink jet print chip portion 105 provided with an ink ejection opening for ejecting the ink, so that the ink is ejected to a printing medium to perform printing.

Further, in such an ink jet print head 100, a bubble collecting portion 108 is formed at the upper side end of the inclined plate member 106, a ventilation hole 109 is provided in the casing 102 in the vicinity of the bubble collecting portion 108, and the ventilation hole 109 is in general provided thereon with a hydrophobic film 110 of a porous material which has a property that air is passed but the ink is not passed so that the ink liquid chamber 103 and outer air are communicated through the hydrophobic film 110 with each other. However, if the ink liquid chamber 103 and outer air are only in a communication state, since ink in the ink liquid chamber evaporates, a bubble discharge portion 111 is provided which is constructed in a closed state that it is normally closed other than when bubbles accumulated in the bubble collecting portion 108. Further, as the hydrophobic film 110, a porous material such as "GOATEX" (tradename) or the like is used.

As shown in the figure, the bubble discharge portion 111 is formed of an enclosure 112 having an opening 113, a lid for closing the opening 113 of the enclosure 112, and a spring 115 for pressing the lid 114. It is constructed so that bubble accumulated in such a bubble collecting portion 108 flows through the hydrophobic film 110 to the bubble discharge portion 111 to be accumulated in the bubble discharge portion 111, bubble accumulated in the bubble discharge portion 111, that is, air, is discharged to the outside.

As described above, in the prior art ink jet print head 100 constructed as shown in FIG. 6, the ink is supplied through the gap S towards the ink jet print chip portion 105, and ejected from the ink jet print chip portion 105 to the printing medium to perform printing. In the ink jet print chip portion 105 in this case, a bubble B is generated by ink ejection, part of the generated bubble B moves through the gap S towards the filter 104 to be adhered to the filter 104. Moreover, such a bubble B adhered to the filter 104 will never pass through the filter 104 due to a meniscus force of the filter 104.

Therefore, in such a state, when bubble B further adheres to the filter 104, bubble B accumulates at the lower side of the filter 104, finally a malfunction occurs in ink supply from the ink vessel to the ink jet print chip portion 105, making stable printing impossible.

It is therefore an object of the present invention, in order to solve such problems in the prior art, to provide a reliable ink jet print head and an ink jet printing apparatus using the ink jet print head which is possible to remove bubbles accumulated in the ink jet print head without unnecessary ink consumption by suction recovery and at a low running cost.

SUMMARY OF THE INVENTION

In accordance with the present invention which attains the above object, there is provided an ink jet print head for ejecting ink to make printing, wherein an ink liquid chamber between a filter and an ink ejection opening for ejecting the ink has means for collecting bubbles, means for moving bubbles to the bubble collecting means, and means for discharging bubbles accumulated in the bubble collecting means to the outside, therefore, suction recovery of the ink jet print head is only in a special case such as an accident or the like, ink consumption amount due to suction recovery is greatly reduced, printing of very low running cost is possible, and a reliable ink jet print head and an ink jet printing apparatus are obtained.

Further, since, in the ink jet print head of the present invention, the bubble collecting means is inclined to the direction of gravity, and two plate members spaced with an interval are used, bubbles can be advantageously collected and discharged, thereby preventing the filter from clogging.

Still further, since, in the ink jet print head of the present invention, a hydrophobic film is used in the means for discharging bubbles to the outside, bubbles can be discharged simply and efficiently.

Yet further, since, in the ink jet print head of the present invention, the hydrophobic film is covered so that it is not exposed directly to outer air other than when removing bubbles, the hydrophobic film can be advantageously protected.

Since, in the ink jet print head of the present invention, in the means for collecting bubbles, the filter is provided inclinedly to the direction of gravity, bubbles can be advantageously conducted and collected using a simple means.

Further, since, in the ink jet print head of the present invention, the cover of the hydrophobic film is a flexible member, the hydrophobic film can be advantageously protected so that bubble are efficiently discharged.

Still further, since, in the ink jet print head of the present invention, the cover of flexible member of the hydrophobic film is provided with a ventilation hole and a check valve, the bubble discharge means can be formed to a simple construction, and bubbles can be discharged simply and efficiently.

Yet further, since, in the ink jet print head of the present invention, the bubble collecting means is combined with the means for moving bubbles, the head can be made to a simple construction.

Since, in the ink jet print head of the present invention, the hydrophobic film is formed of a porous material which passes through a gas but does not pass a liquid, only bubbles can be advantageously passed through and discharged.

Further, since, the ink jet print head of the present invention has an electrothermal converter for generating a thermal energy according to energizing as an energy utilized for ejecting the ink, the ink can be advantageously ejected to the printing medium to perform good and stable printing.

Still further, since, in the ink jet print head of the present invention, utilizing film boiling generated in the ink by the thermal energy applied by the electrothermal converter, the ink is ejected from the ink ejection opening towards the printing medium, the ink can be advantageously ejected to perform stable printing, thereby improving and maintaining the printing quality.

Yet further, since, in the ink jet print head of the present invention, printing is performed using any one of the above ink jet print heads, suction recovery of the ink jet print head is only a special case, such as an accident, ink consumption amount by recovery operation is remarkably reduced, thereby obtaining a reliable ink jet print head and an ink jet printing apparatus of a very low running cost.

The above and other objects, effects, features and advantages of the present invention will become more apparent from the following description of embodiments thereof taken in conjunction with the accompanying drawings.

DETAILED DESCRIPTION OF PREFERRED EMBODIMENTS

According to the ink jet print head and the ink jet printing apparatus of the present invention constructed like this, by the construction as described above, bubbles accumulated in the ink jet print head can be removed without useless ink consumption by suction recovery, and a low running-cost and reliable ink jet print head and an ink jet printing apparatus using the ink jet print head are obtained.

These and other objects, features, and advantages of the present invention will become more apparent from the following description of the preferred embodiments taken in conjunction with the accompanying drawings.

In the following, the ink jet print head, and the ink jet printing apparatus using the ink jet print head of the present invention will be described in detail with reference to the drawings.

Embodiment 1

Figure 1:
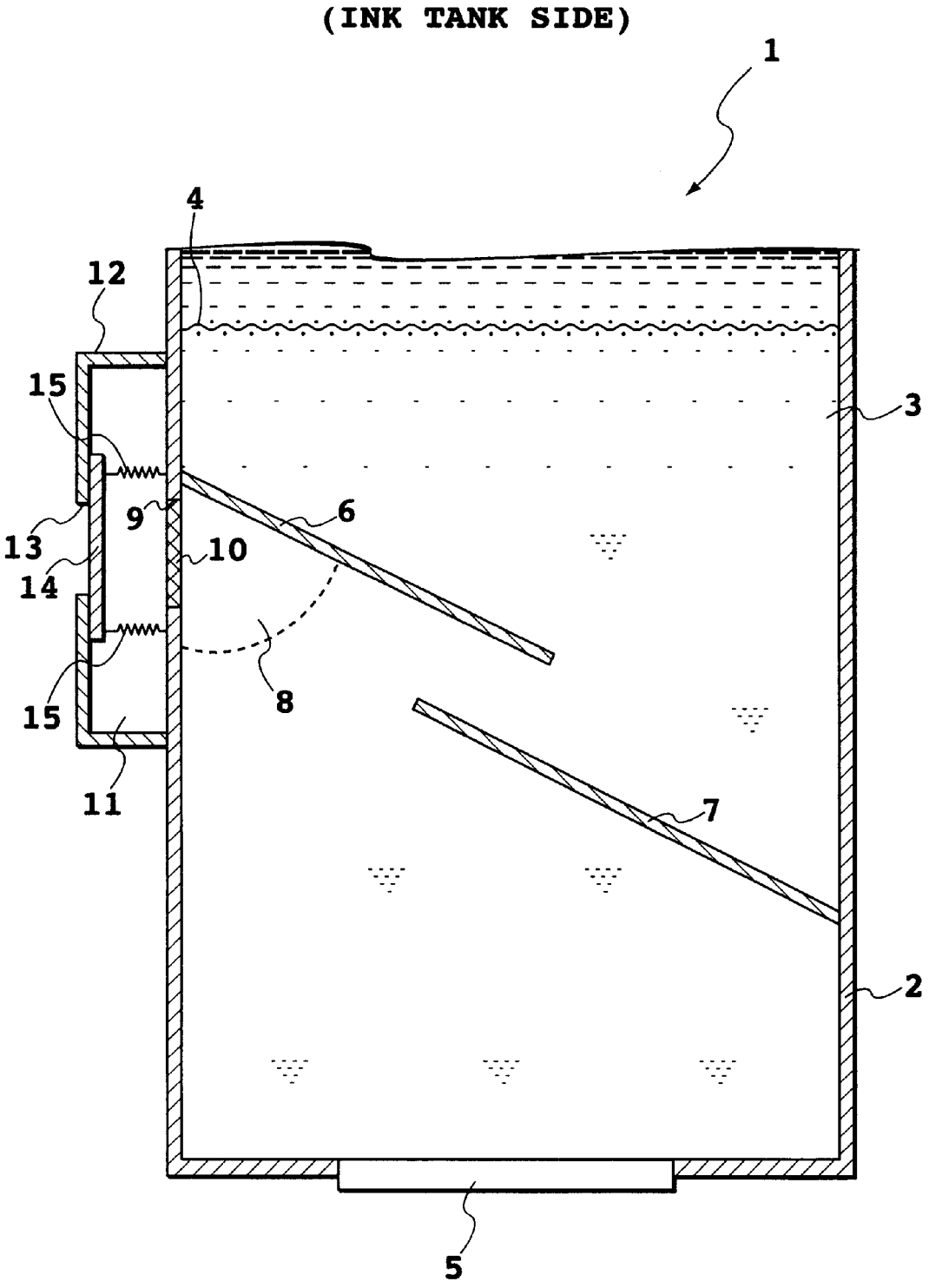
FIG. 1 is a cross sectional diagram of the ink jet print head according to an embodiment 1 of the present invention.

FIG. 1 is a cross sectional diagram showing embodiment 1 of the ink jet print head according to the present invention. An ink jet print head 1 of the present invention shown in FIG. 1 is, though not shown, connected to an ink tank containing ink above the figure. In the present embodiment, the ink jet print head 1 adopts an ink jet print cartridge type in which the ink tank containing the ink and the ink jet print head are connected, however, the ink supply method to the ink jet print head is not limited to this, but it is of course that it may be a type in which an ink vessel such as an ink tank is set at a place away from the ink jet print head, and the ink is supplied through an ink supply tube.

Figure 2:
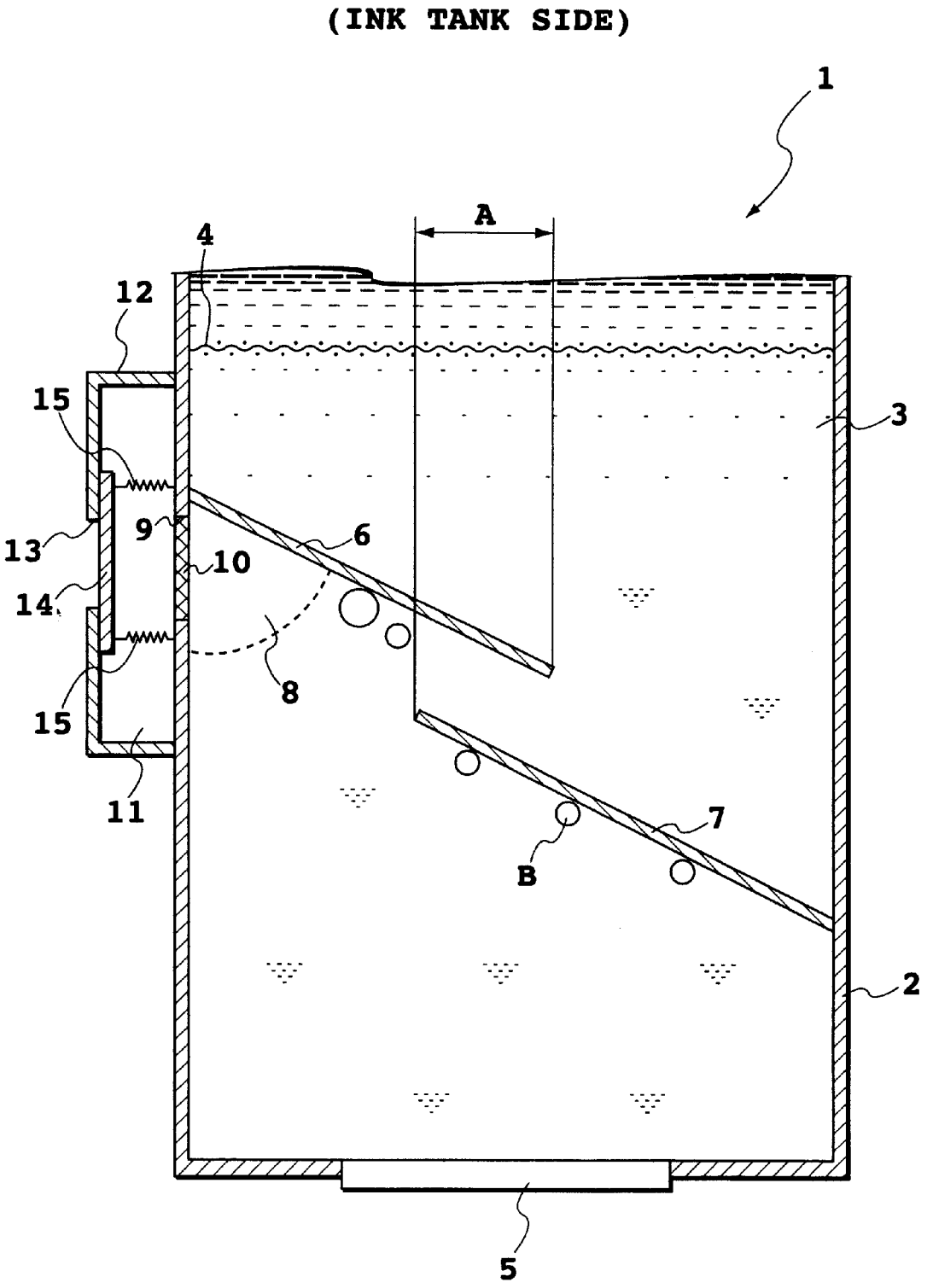
FIG. 2 is a cross sectional diagram of the ink jet print head showing movement of bubbles in an ink liquid chamber in embodiment 1 of the present invention of FIG. 1.

As shown in FIG. 1, the ink jet print head 1 in the present invention has a casing 2 integrated with an ink vessel such as an ink tank and forming an ink liquid chamber 3, a filter 4 is provided between the casing 2 and the ink vessel and, at the opposite side to the filter 4, has an ink jet print chip portion 5 for ejecting the ink to perform printing. The filter 4 is to remove impurities such as dust contained in the ink supplied from the ink vessel so that a clean ink is supplied into the ink liquid chamber 3. In the ink liquid chamber 3, two plate members 6 and 7 are disposed inclinedly in the same direction and spaced with an interval, so that opposing ends of these plate members 6 and 7 form an overlapping portion A as shown in FIG. 2. Therefore, ink supplied into the ink liquid chamber 3 passes between the two plate members 6 and 7 to be supplied to the ink jet print chip portion 5 equipped with an energy generation means for ejecting the ink and an ink ejection opening for ejecting the ink, so that the ink is ejected to a printing medium to perform printing.

In the present embodiment, as the ink jet print head 1 for ejecting the ink, an ink jet print head of a bubble jet type is constructed, in which by energizing a heater provided on a heater board (not shown), the heater is heated to generate film boiling in the ink present on the heater thereby ejecting the ink. However, the ink jet print head usable in the present invention is not limited to such a bubble jet type, but may be one which can eject a desired amount of ink to a desired position, such as a piezo type by flowing an electric current in a piezoelectric element to cause transformation in the piezoelectric element thereby ejecting the ink or an electrostatic head for ejecting the ink by an electrostatic force.

Further, in the present embodiment, a bubble collecting portion 8 is formed at the end of the inclined upper side plate member 6, a ventilation hole 9 is provided in the casing 2 in the vicinity of the bubble collecting portion 8, on the ventilation hole 9, a hydrophobic film 10 of a porous material which allows air to pass but does not pass the ink is mounted, so that the ink liquid chamber 3 and the outer air are communicated through the hydrophobic film 10. However, if the ink liquid chamber 3 and the outer air are always in a communication state, since the ink in the ink liquid chamber 3 evaporates, a bubble discharge portion 11 is provided which is normally in a nearly closed state other than when bubbles accumulated in the bubble collecting portion 8 are removed.

Figure 3:
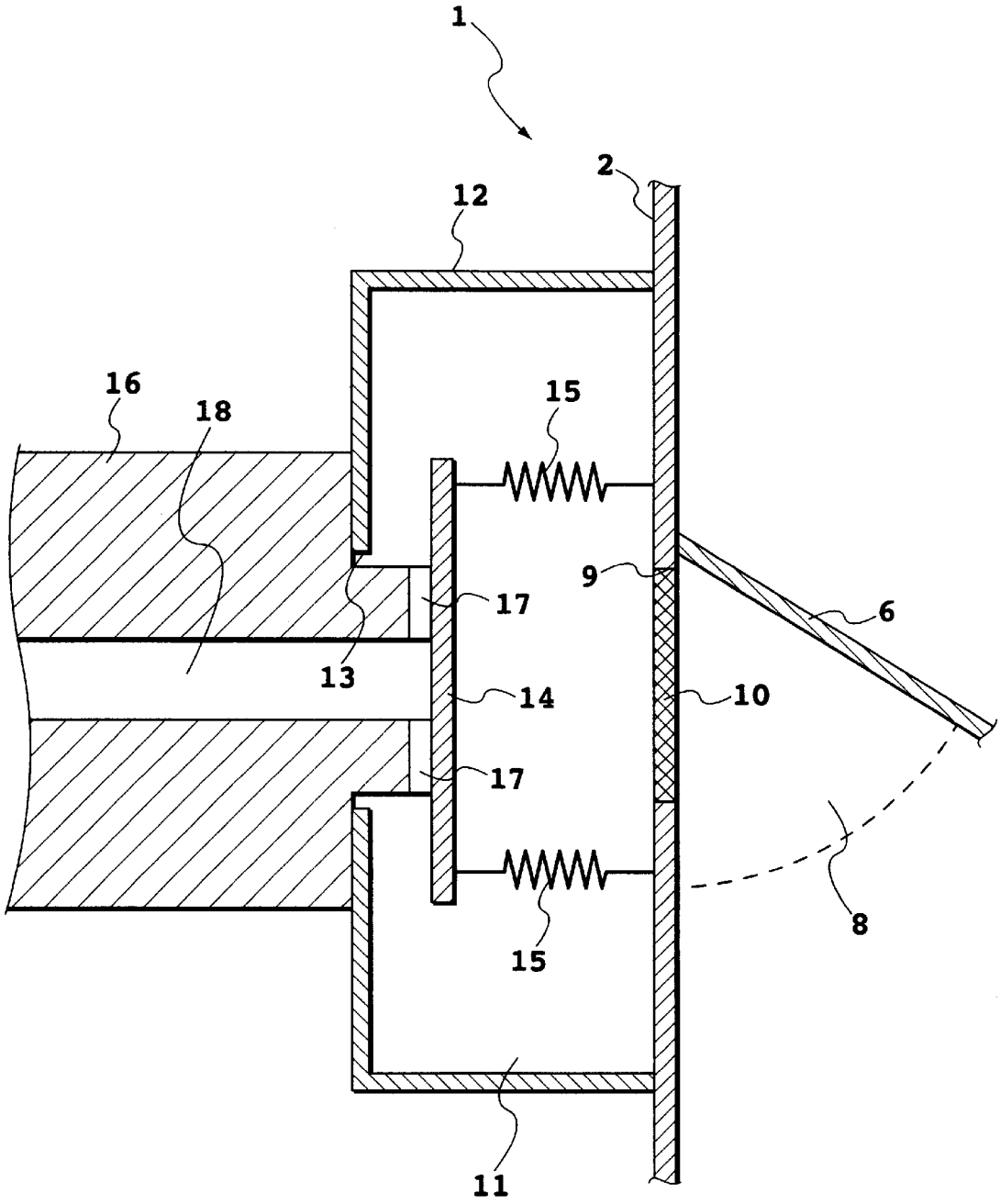
FIG. 3 is a cross sectional diagram showing a state engaged with a joint portion provided in the ink jet print head and the ink jet printing apparatus in embodiment 1 of the present invention.

As shown in FIG. 3, the bubble discharge portion 11 is formed of an enclosure 12 having an opening 13, a lid 14 for closing the opening 13 of the enclosure 12, and springs 15 for pressing the lid 14. Therefore, it is constructed that bubbles accumulated in the bubble collecting portion 8 flow through the hydrophobic film 10 to the bubble discharge portion 11 to be accumulated in the bubble discharge portion 11 so that bubbles accumulated in the bubble discharge portion 11, that is, air is discharged to the outside by a method which will be described later.

For the hydrophobic film 10 provided on the ventilation hole 9 of the casing 2, similarly a porous material, for example, such as GOATEX (tradename) made by Japan Goatex Co. is used, however, such a porous material is not specifically limited, but a similar other material having similar function can be used with no problem.

When performing printing using the ink jet print head 1 of the present invention constructed as above described, bubbles generated during printing, as shown in FIG. 2, collect towards the upper side along the plate members 6 and 7 to the bubble collecting portion 8. Further, the plate members 6 and 7 form an overlapping portion A, accordingly, bubbles first move towards the upper side along the lower side ink tank member 7, transfer through the overlapping portion A to the upper side plate member 6, and then, move upward along the upper side plate member 6. On the other hand, the ink is supplied through the overlapping portion A to the ink jet print chip portion 5.

Figure 6:
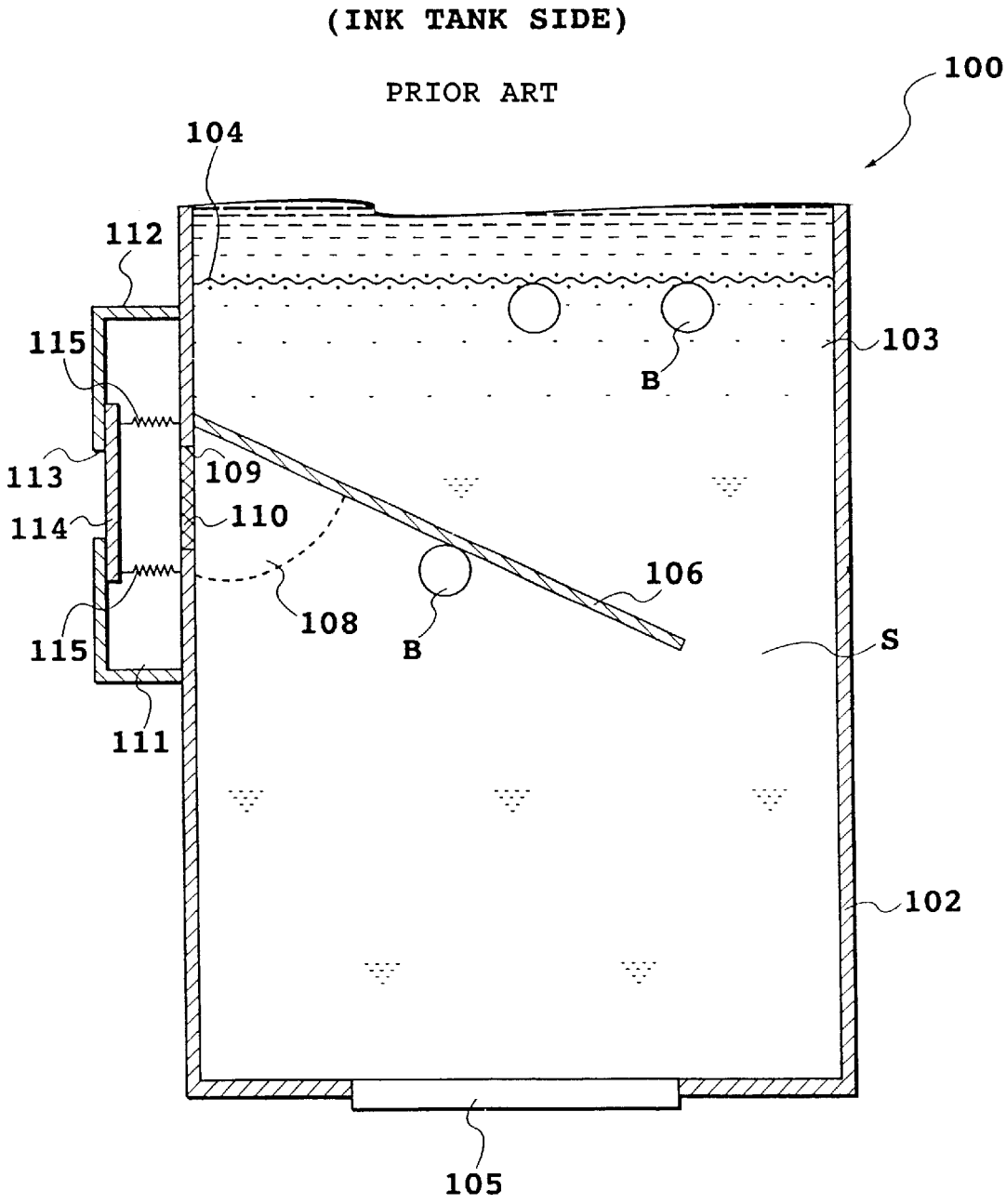
FIG. 6 is a cross sectional diagram showing movement of bubbles in an ink liquid chamber in a prior art ink jet print head compared with embodiment 1 of the ink jet print head of the present invention.

However, when only a single sheet of plate member 106 is used as in a prior art ink jet print head 100, as described above with FIG. 6, a gap S for supplying the ink is formed at the lower end side of the inclined plate member 106, the ink is supplied through the gap S to the ink jet print chip portion 105 and ejected from the ink jet print chip portion 105 to the printing medium to perform printing. Therefore, by ink ejection in the ink jet print chip portion 105 in this case, air bubbles B are generated, and part of the generated bubbles B moves towards the filter 104 and adheres to the filter 104. However, such bubbles adhered to the filter 104 will almost never pass through the filter 104 spontaneously due to a meniscus force of the filter 104. Therefore, in such a state, if bubbles B adhere further to the filter 104, bubbles B collect at the lower side of the filter 104, finally, a malfunction occurs in ink supply to the ink jet print chip portion 105, thus causing impossibility of stable printing.

Therefore, in the ink jet print head 1 of the present invention invented for solving such problems, to discharge air bubbles, when some amount of bubbles is collected in the bubble collecting portion 8, the carriage is moved to a predetermined position of the ink jet printing apparatus, and, as shown in FIG. 3, by a bubble removing joint member 16 provided on the ink jet print head 1, a lid 14 of the bubble discharge portion 11 is pressed inwardly against the spring forces of the springs 15, so that the enclosure 12 and the joint member 16 are engaged. Next, when air is sucked through a suction hole 18 of the bubble removing joint member 16, the bubbles accumulated in the bubble collecting portion 8 in the ink jet print head are sucked out to the outside of the ink jet print head 1 through a suction grooves 17 and the suction hole 18 of the bubble removing joint member 16 through the bubble discharge portion 11. Since when suction pressure at this time is at the extent that the ink is not sucked from the hydrophobic film 10, only bubbles are removed from the ink jet print head 1, after a necessary suction if performed for an optional time to discharge a sufficient amount of air is discharged, the bubble removing joint member 16 may be disconnected to remove engagement of the enclosure 12 with the joint member 16, thereby discharging air by a simple operation without a complex sequence.

Therefore, as described above, with the ink jet print head of the present invention and an ink jet printing apparatus using such an ink jet print head, reliable and low running cost printing can be performed.

Embodiment 2

Figure 4:
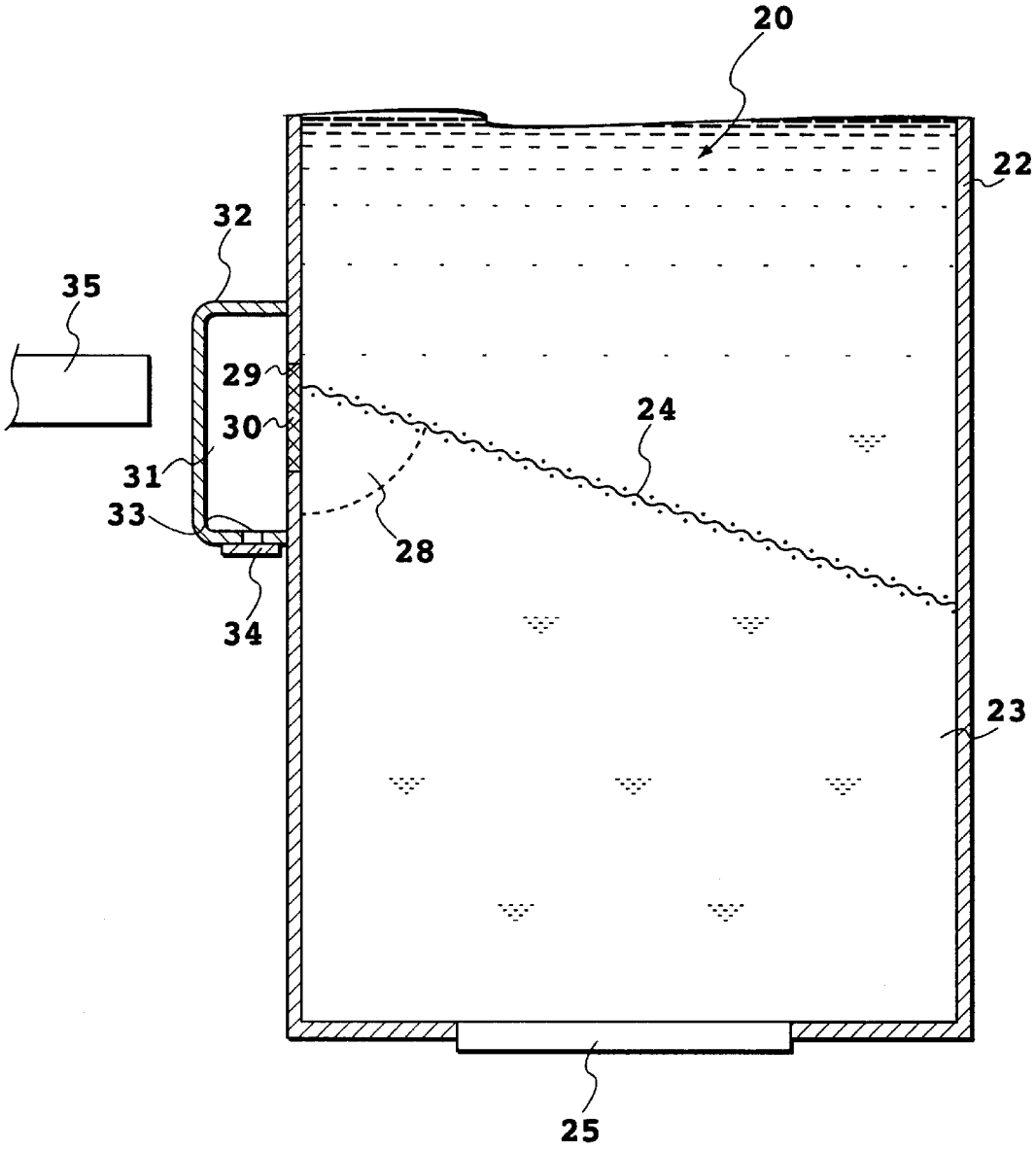
FIG. 4 is a cross sectional diagram showing a pressing member provided in the ink jet print head and the ink jet printing apparatus in embodiment 1 of the present invention.
Figure 5:
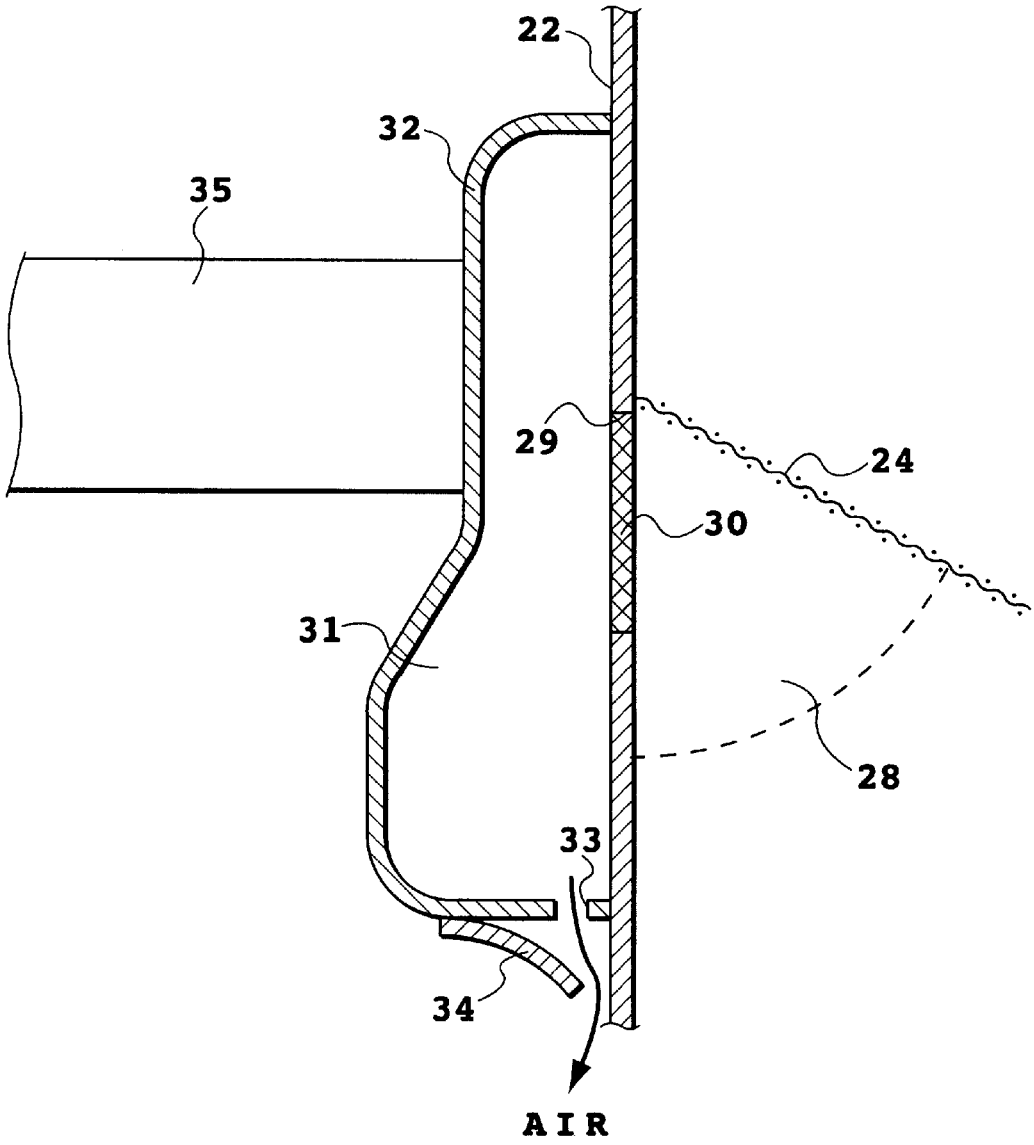
FIG. 5 is an enlarged partial cross sectional diagram for explaining operation of a flexible member in an embodiment 2 of the present invention in FIG. 4.

Next, in describing an embodiment 2 of the ink jet print head according to the present invention, FIGS. 4 and 5 are a cross sectional diagram and a partial enlarged cross sectional diagram showing the ink jet print head of the embodiment 2 of the present invention.

As shown in the figures, an ink jet print head 20 of embodiment 2 of the present invention has a filter 24 provided inclinedly in a casing 22 having an ink jet print chip portion 25 and forming an ink liquid chamber 23, a hydrophobic film 30 of a porous material such as GOATEX (tradename) mounted on an opening 29 portion of the casing 22 provided corresponding to a bubble collecting portion 28 formed at an end of the filter 24, a flexible member 32 forming a cover provided to cover and seal the hydrophobic film 30 and forming an ink discharge portion 31, and a check valve 34 provided to open and close a ventilation hole 33 formed in the flexible member 32. The check valve 34 is constructed to open only in a direction to discharge air in the ink discharge portion 31 of the flexible member 32 to the outside.

In the present embodiment, when bubbles generated in the ink liquid chamber 23 and accumulated in the bubble discharge portion 31 are removed, by a pressing member 35 of a pressure means equipped in the ink jet printing apparatus, the flexible member 32 provided on the ink jet print head 20 is pressed as shown in FIG. 5. As a result, the flexible member 32 is pressed and deformed by the pressure of the pressing member 35, the check valve 34 is opened, and air in the flexible member 32 is discharged through the ventilation hole 33 to the outside. After that, when pressing of the flexible member 32 by the pressing member 35 is discontinued, the check valve 34 is closed, and the flexible member 32 is reverted back to the original shape. At this moment, since the pressure of air present in the flexible member 32 is reduced, utilizing this pressure, bubbles present in the bubble collecting portion 28 in the ink jet print head 20 are sucked through the hydrophobic film 30 into the bubble discharge portion 31 to be accumulated in the bubble discharge portion 31. Therefore, the bubbles accumulated in the bubble discharge portion 31, that is, air, can be discharged to the outside of the ink jet print head 20 through the ventilation hole 33 of the flexible member 32 by pressing the flexible member 32 by the pressing member 35 as described above.

As described above, according to the present invention, by providing two plate members inclinedly and with an interval in the ink jet print head so that a bubble collecting portion is formed at a predetermined position in the ink jet print head, or by providing a filter inclinedly, it is constructed that bubbles generated in the ink jet print head is conducted to the bubble collecting portion, the accumulated bubbles are discharged through the hydrophobic film provided in the ink jet print head to the outside, whereby suction recovery of the ink jet print head is only a special case such as an accident, ink consumption amount by recovery operation is remarkably reduced, and a very low running cost and reliable ink jet print head and an ink jet printing apparatus using the ink jet print head are obtained.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out a preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet print head for ejecting an ink to perform printing characterized by comprising:

means for collecting bubbles in an ink liquid chamber, said means for collecting bubbles being disposed between a filter and an ink ejection opening for ejecting the ink;

means for moving bubbles to said bubble collecting means; and means for discharging bubbles accumulated in said bubble collection means to outside, wherein said bubble moving means comprises two plate members inclined to a gravitational direction and spaced with an interval, and wherein said means for discharging bubbles to outside comprises a hydrophobic film.

2. The ink jet print head as claimed in claim 1, wherein said hydrophobic film is covered so as not to be exposed directly to outer air other than a time of removing bubbles.

3. The ink jet print head as claimed in claim 1, wherein said bubble collecting means is combined with said bubble moving means.

4. The ink jet print head as claimed in claim 1, wherein said hydrophobic film is formed of a porous material which passes a gas but does not pass a liquid.

5. The ink jet print head as claimed in claim 1, having an electrothermal converter for generating a thermal energy according to energizing as an energy utilized for ejecting the ink.

6. The ink jet print head as claimed in claim 5, wherein utilizing a film boiling generated in the ink by thermal energy applied by said electrothermal converter, said ink is ejected from said ink ejection opening towards a printing medium.

* * * * *